US007137898B2

(12) United States Patent
Savage

(10) Patent No.: US 7,137,898 B2
(45) Date of Patent: Nov. 21, 2006

(54) KNOCKDOWN LABYRINTH FRAMEWORK

(76) Inventor: Pierre Savage, 116, Dany, Granby, Quebec (CA) J0E 2A0

( * ) Notice: Subject to any disclaimer, the term of this patent is extended or adjusted under 35 U.S.C. 154(b) by 47 days.

(21) Appl. No.: 11/048,953

(22) Filed: Feb. 1, 2005

(65) Prior Publication Data

US 2005/0170901 A1 Aug. 4, 2005

Related U.S. Application Data

(60) Provisional application No. 60/541,283, filed on Feb. 2, 2004.

(51) Int. Cl.
*A63J 11/00* (2006.01)

(52) U.S. Cl. ..... 472/62; 52/238.1

(58) Field of Classification Search ..... 472/57, 472/62, 137; 52/238.1, 239, 243.1
See application file for complete search history.

(56) References Cited

U.S. PATENT DOCUMENTS 2,976,923 A * 3/1961 Hirashiki ..... 160/229.1
5,046,720 A 9/1991 Bolly
5,219,316 A 6/1993 Huffman
5,364,311 A 11/1994 Chou
5,474,501 A 12/1995 Teng
6,398,659 B1 6/2002 Karg
6,493,995 B1 * 12/2002 McKenzie ..... 52/36.4
6,575,462 B1 6/2003 Roy
6,675,538 B1 * 1/2004 Candio ..... 52/65
6,772,567 B1 * 8/2004 Diffrient, Jr. et al. ..... 52/239

* cited by examiner

*Primary Examiner*—Kien Nguyen

(57) ABSTRACT

A knockdown labyrinth framework made up of tubes interconnected to make a base unit which itself combines with three others by way of a connection hub to make up a master square. Each such master square is then connected to other master squares. Vertical tubes join the lower structure to an upper structure which has hanging rods from which is hung a partitioning canvas which traces the path to form the labyrinth. Each tube connects and locks in with the next tube by way of frictional interlock which does not require any tools so that it is easy to set up and knockdown afterward.

2 Claims, 10 Drawing Sheets

KNOCKDOWN LABYRINTH FRAMEWORK

Figure 1:
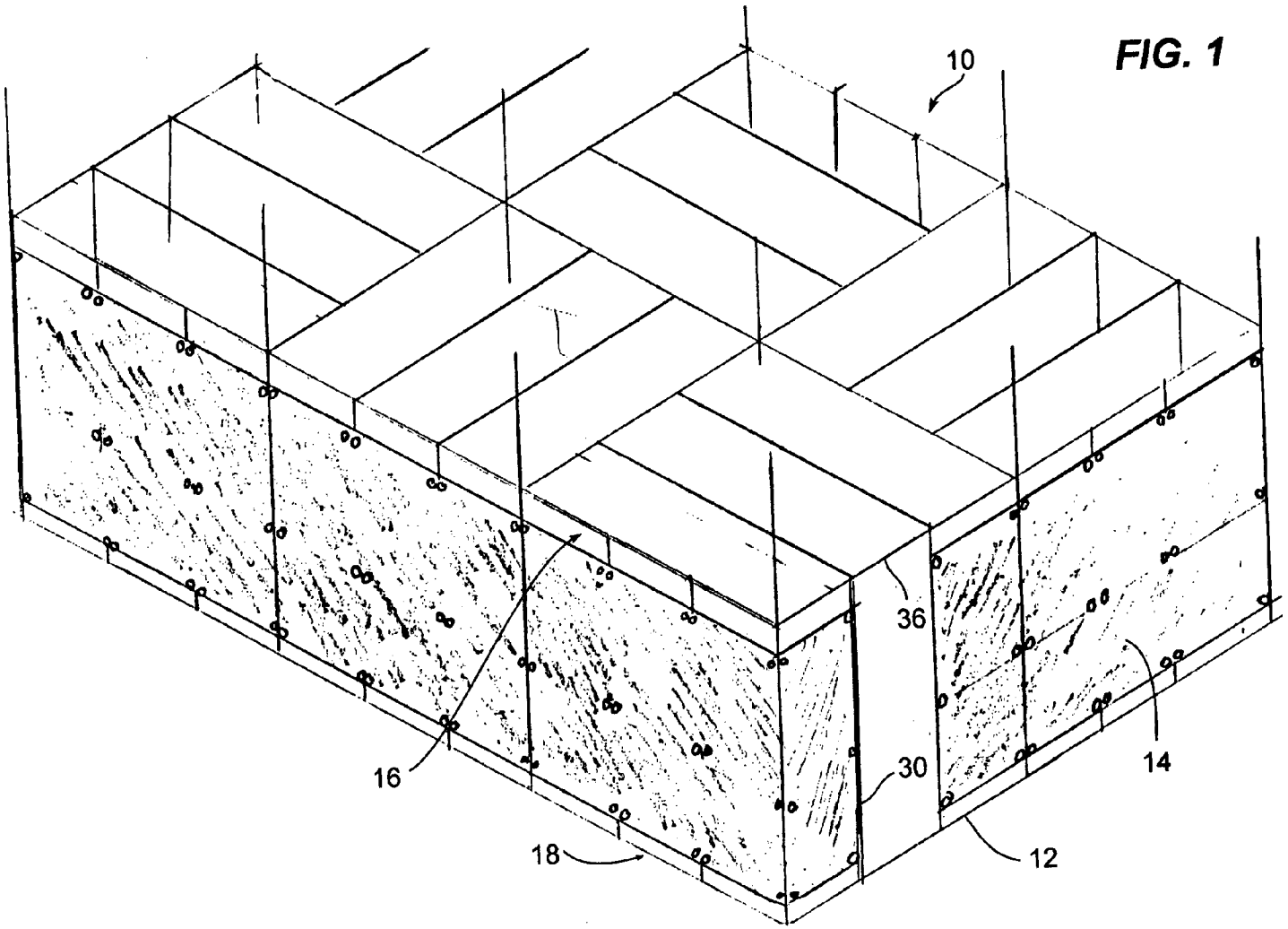

This application claims priority based on provisional application 60/541,283 filed Feb. 2, 2004

BACKGROUND OF THE INVENTION

1. Field of the Invention

The invention relates generally to tubular framework but more particularly to labyrinth or maze made up of interlocking pieces of tubes to create limitless shapes for use in a maze.

2. Background of the Invention

Lifesize mazes have been around for ages and were popular in renaissance Europe as a distraction to royalty. Over the centuries, the concept has evolved and has seen a resurgence in popularity in recent years. Most structures use wire mesh fence as a basic structure and sometimes add an opaque canvas hung on the fence so as to keep the alleys visibly isolated.

The prior art shows various types of structures to make labyrinths easily dismantleable such as for use in county fairs and such where a temporary structure is desired.

For example, U.S. Pat. No. 5,046,720 shows an amusement maze located inside of a building. The maze is formed by upright flexible panels which are appropriately arranged in selected longitudinally and laterally extending patterns. The panels are supported by ropes anchored to a single sidewall of the building and are suspended above the floor of the building by wires which extend upwardly to the ceiling.

U.S. Pat. No. 5,219,316 shows a portable self-supporting, compactible armed competition arena which comprises a floor covering having markings which layout a plan for the arena and upon which the arena is assembled. The markings comprise indicia which alpha-numerically or otherwise identify wall and other arena construction parts to be assembled at the marked locations. Wall parts and other arena parts identified by the floor covering markings likewise bear tags comprising identifiers which correlate with the markings such that each identified part has a predefined unique location on the floor covering and in the arena structure. When totally assembled, the arena comprises a unitized structure which withstands wind and body loads. When used out-of-doors, tie-downs provide additional stability against wind load.

U.S. Pat. No. 5,364,311 shows a collapsible labyrinth constructed with a plurality of collapsible separating boards temporarily secured by vertical pivotal posts, two horizontal bars respectively on and under a line of separating boards to secure upper and lower ends of the pivotal posts, and tenons fitting in a mortise in a lower end of each separating board and also in one of tenon holes preset in the ground for securing temporatily each separating board so that the boards can be altered in position to make up a labyrinth route.

U.S. Pat. No. 5,474,501 shows a maze including a plurality of posts, a plurality of stretching members for inserting into longitudinal slots on the posts to reinforce the structural strength of the posts, a plurality of coupling members end matched between either two posts, and a plurality of partition members for connection horizontally between either two posts to define a network of intricate passages.

U.S. Pat. No. 6,398,659 shows an apparatus comprising a maze game that can be used indoors or outdoors and which has vertical poles and horizontal poles that interconnect together to make up the frame of the maze apparatus. The panels are made of fabrics and are readily attached and detached from the horizontal poles such that the panels hang downwardly from the horizontal poles to establish the various isolated pathways through the maze.

U.S. Pat. No. 6,575,462 shows a maze structure having plural levels, each with a floor and upstanding walls arranged in a maze-like pattern and dividing each level into a plurality of separate chambers. Openings are located in the top and bottom sides of the levels for communication of the chambers of one level with chambers of adjacent levels when the levels are stacked. Having the chambers of adjacent levels being arranged to communicate with one another regardless of the relative orientation of the levels permits any one level to be rotated about a vertical axis in relation to the other levels as well as permitting a plurality of different stacking orders to produce numerous different combinations and different solutions to the maze structure.

The prior art suffers from certain drawbacks such as the fragility of the structure which has weak ground anchoring, "soft" wall which can be lifted as easily as one lifts a curtain or else, over elaborate structure mechanisms which make it hard to assemble or disassemble.

SUMMARY OF THE INVENTION

In view of the foregoing disadvantages inherent in the known devices now present in the prior art, the present invention, which will be described subsequently in greater detail, generally comprises a labyrinth framework made up of tubes interconnected to make a base unit which itself combines with three others by way of a connection hub to make up a master square. Each such master square is then connected to other master squares. Vertical tubes join the lower structure to an upper structure from which is hung a partitioning canvas which traces the path to form the labyrinth. Each tube connects and locks in with the next tube by way of frictional interlock which does not require any tools so that it is easy to set up and knockdown afterward.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE PREFERRED EMBODIMENT

FIG. 1 Orthogonal view of the labyrinth in general.

Figure 2:
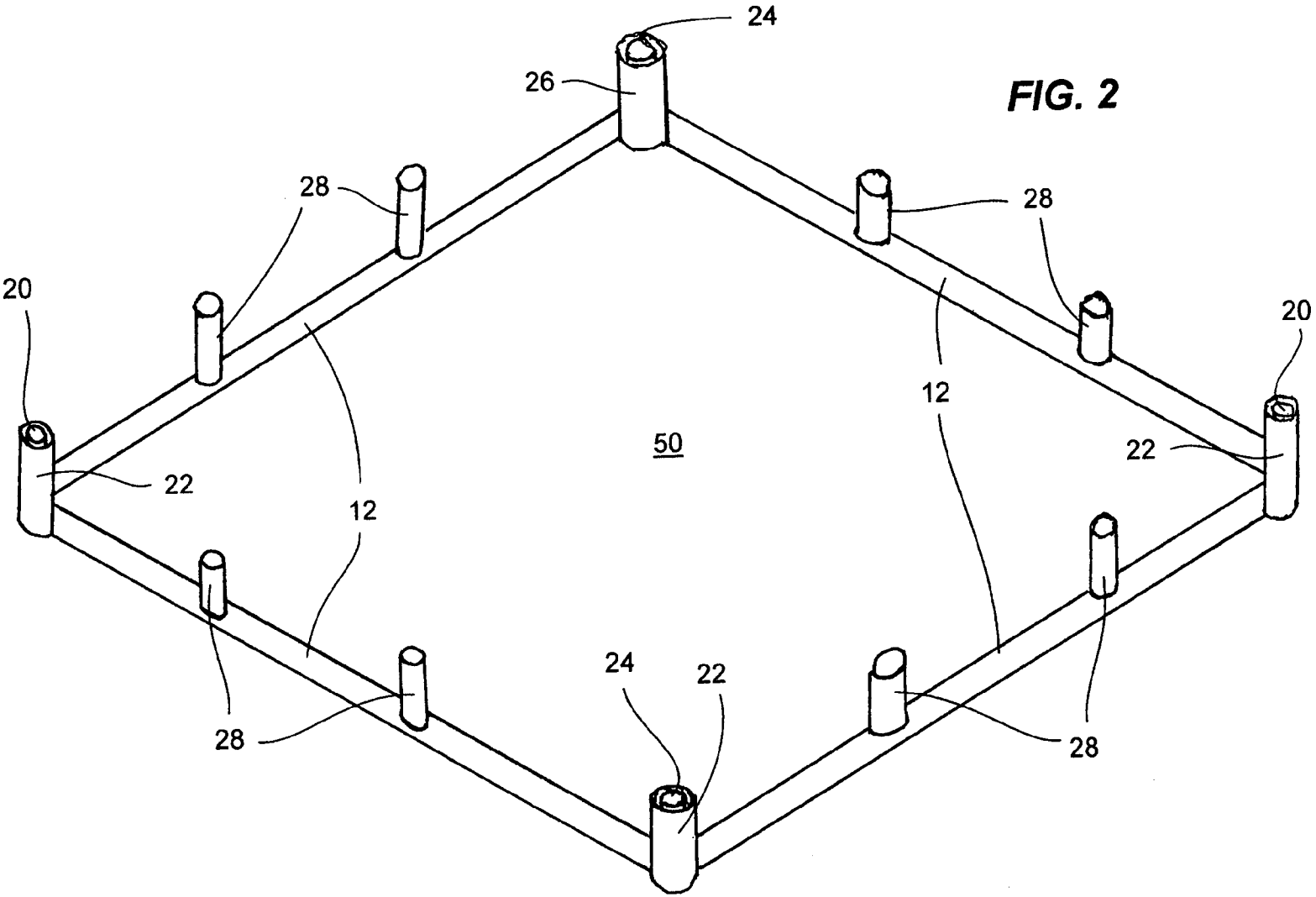

FIG. 2 Orthogonal view of the lower section of a base unit.

Figure 3:
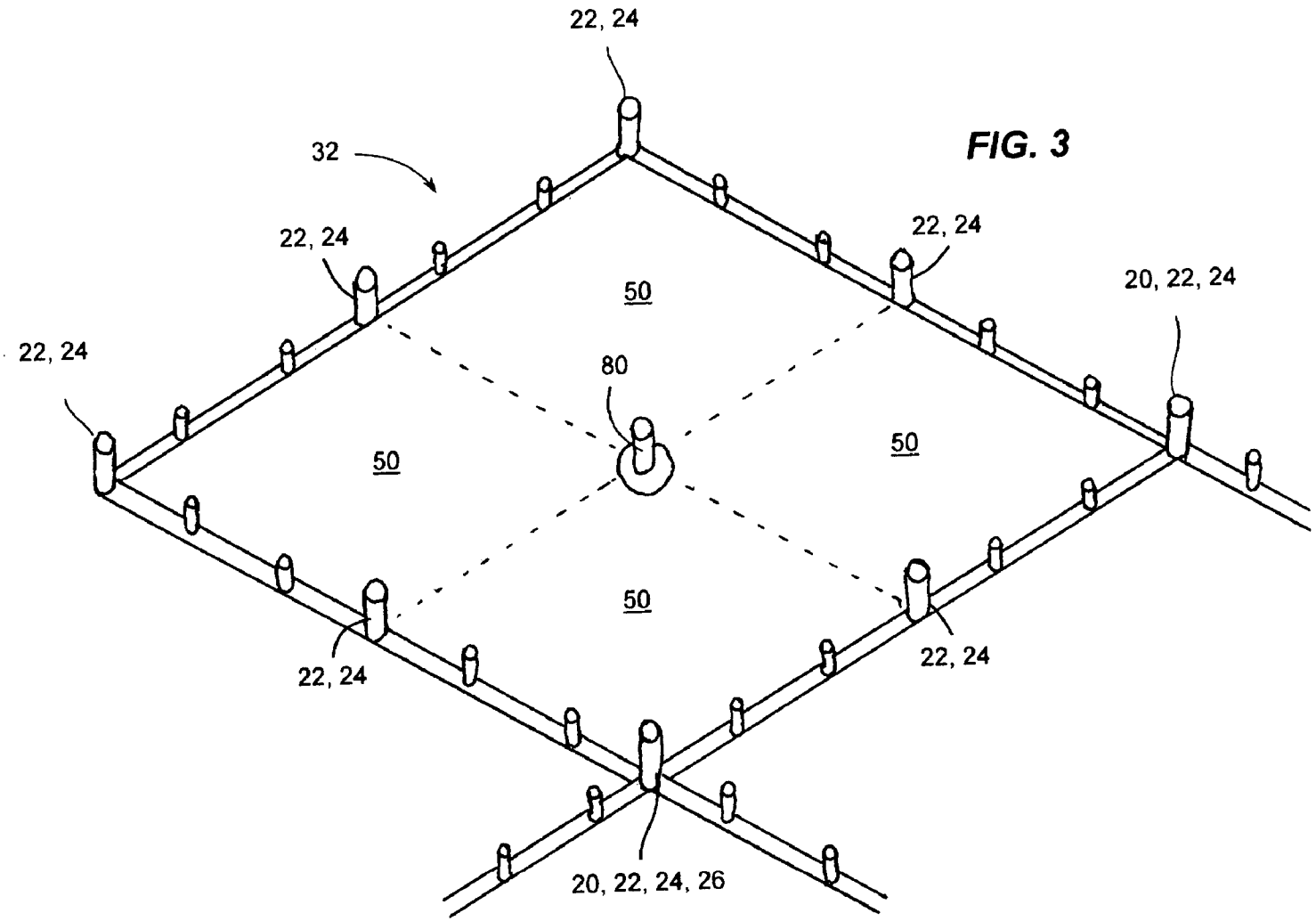

FIG. 3 Orthogonal view of the lower section of a master square.

Figure 4:
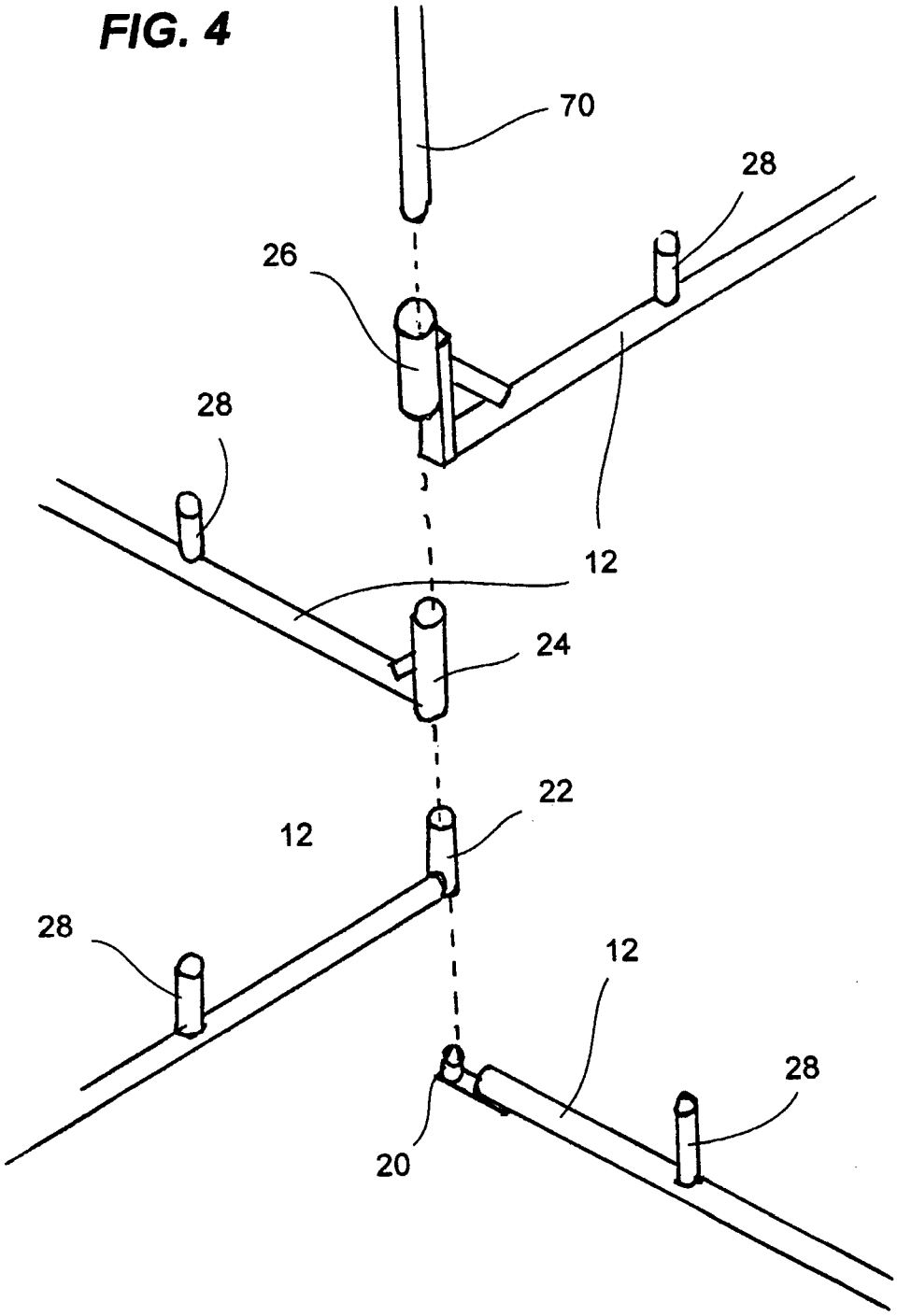

FIG. 4 Orthogonal exploded view of a connection hub.

Figure 5:
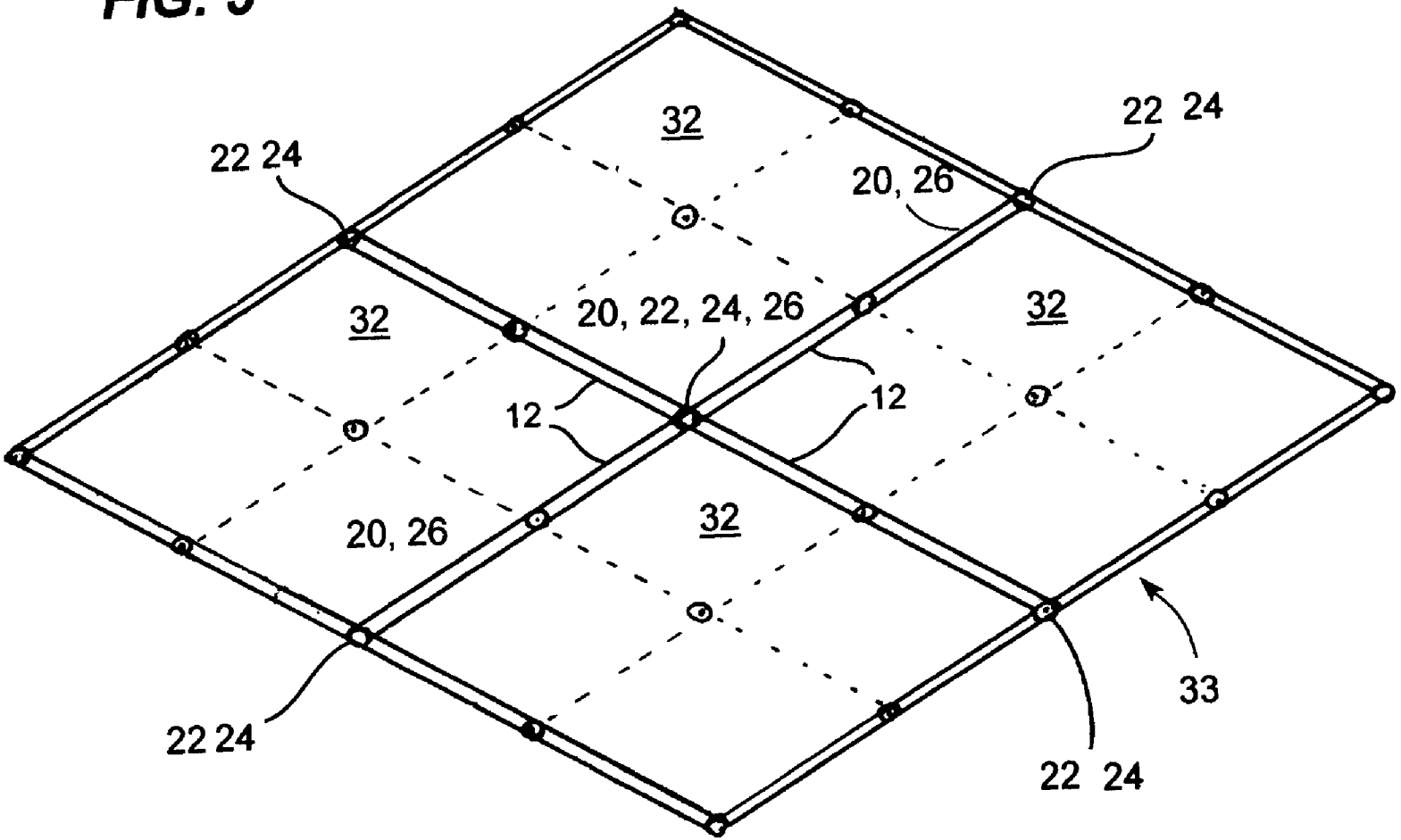

FIG. 5 Orthogonal view of the lower section of four master squares to form a grid.

Figure 6:
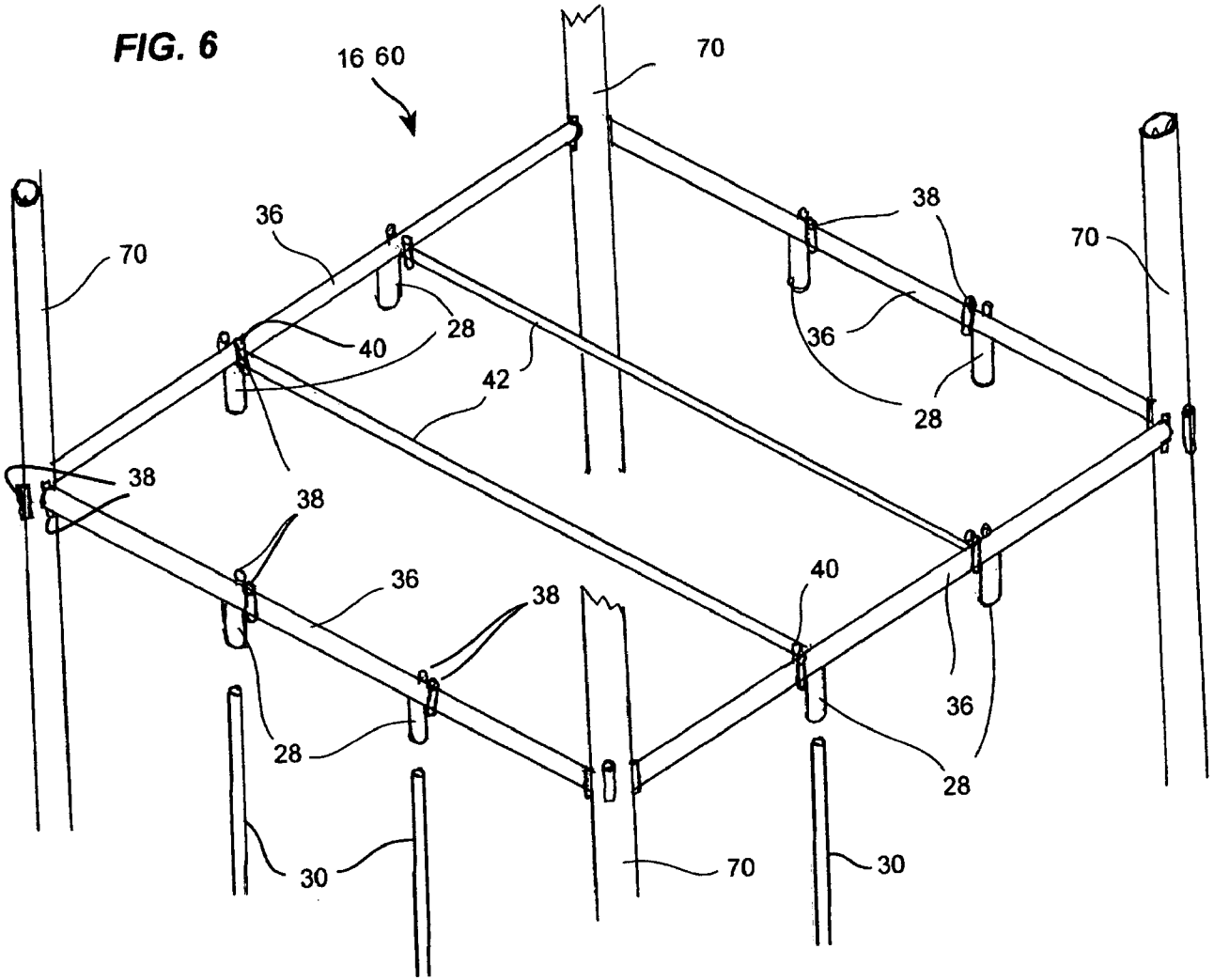

FIG. 6 Orthogonal view of the upper section of a base unit.

Figure 7:
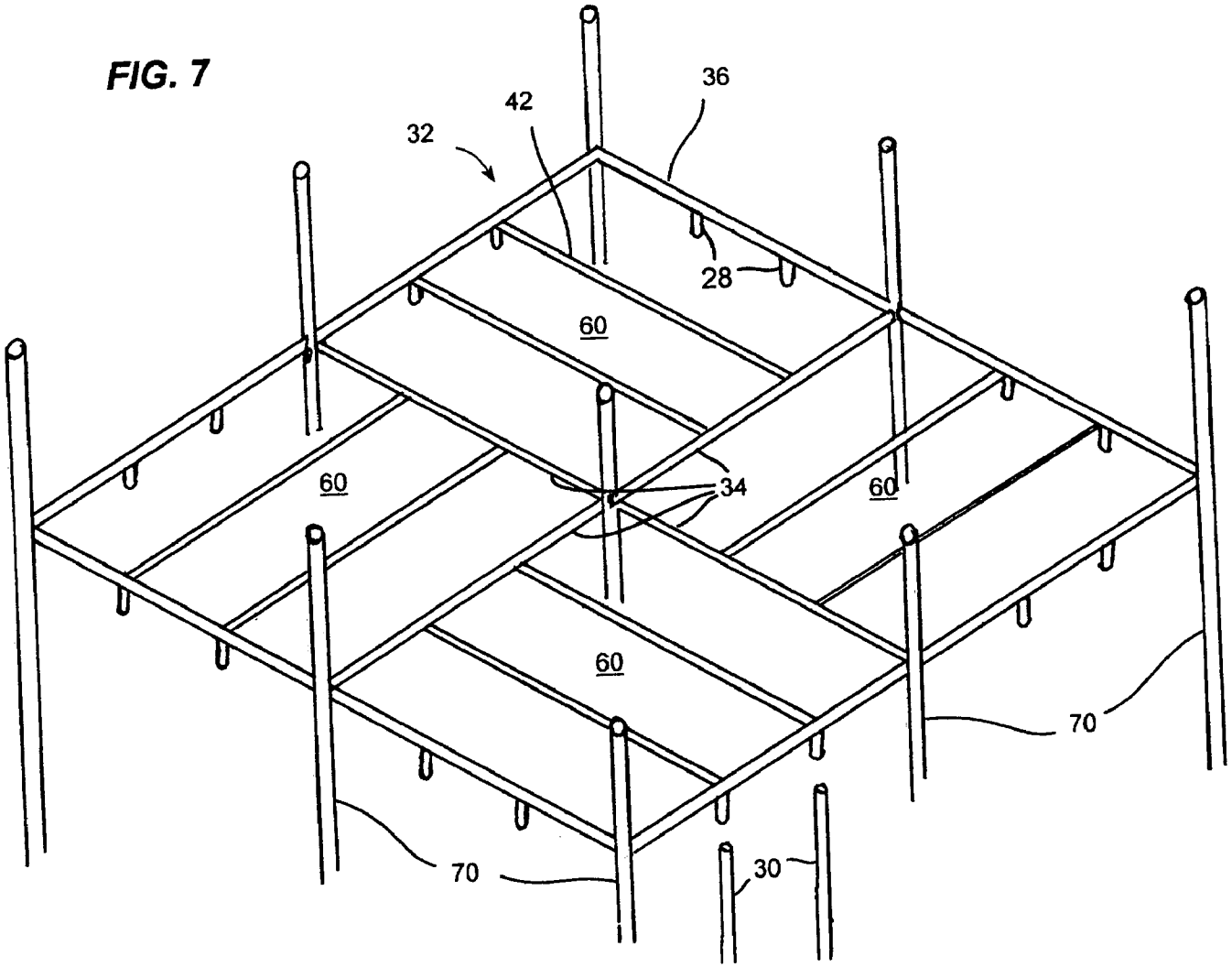

FIG. 7 Orthogonal view of the upper section of a master square.

Figure 8:
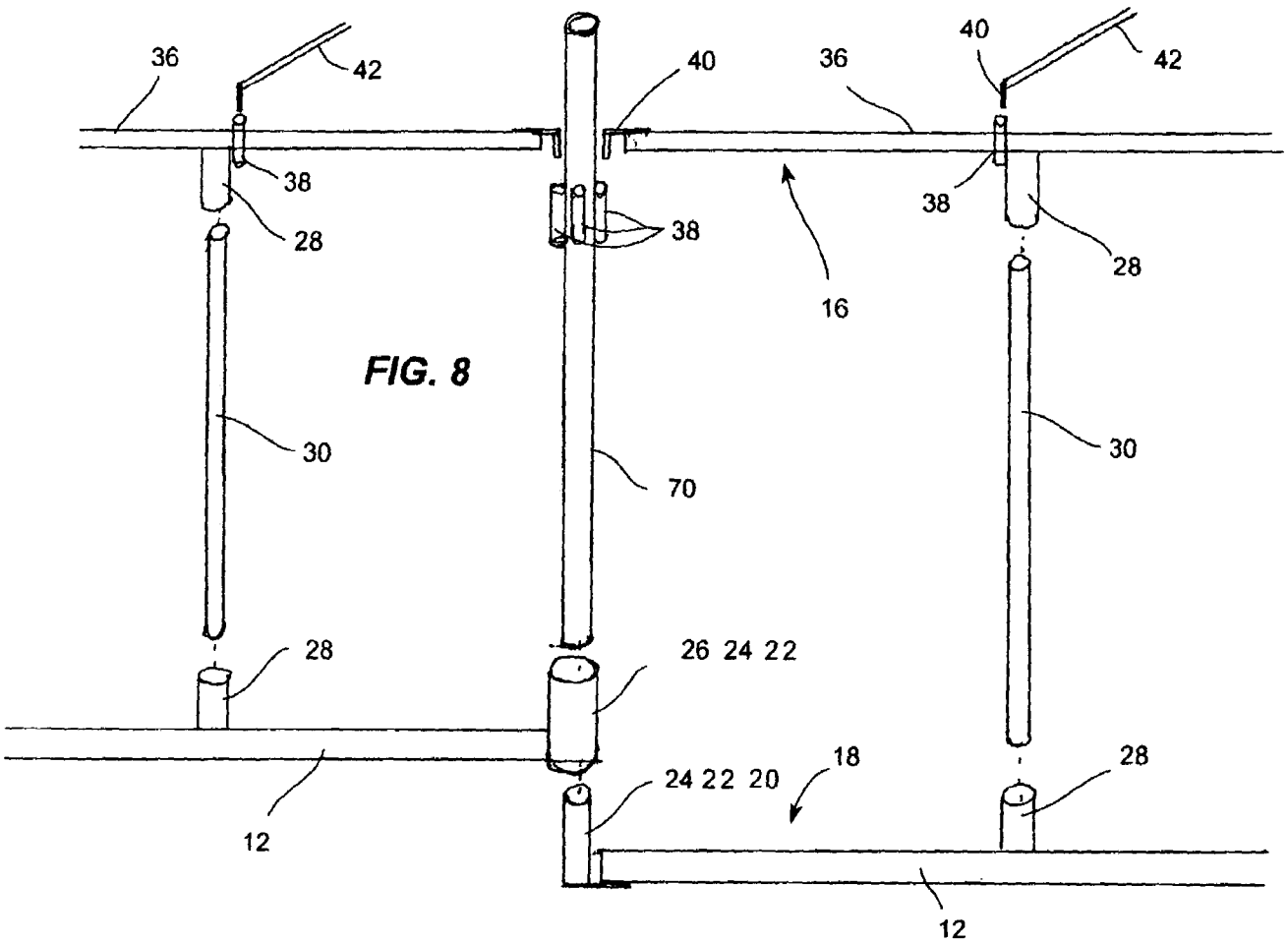

FIG. 8 Orthogonal view showing how pieces connect between them.

FIGS. 9*a–d* Orthogonal view of a series of lower tubes showing some of the combinations of ends they can have.

FIG. 10*abc* Orthogonal view of a transverse bar, upper tube, and upper tube.

DETAILED DESCRIPTION OF THE PREFERRED EMBODIMENT

FIG. 1 A knockdown labyrinth framework (10) has a series of interconnected tubes divided into lower tubes (12), vertical tubes (30), and upper tubes (36). It also has a canvas (14) hanging from an upper structure (16) down to a lower structure (18).

Figure 9:
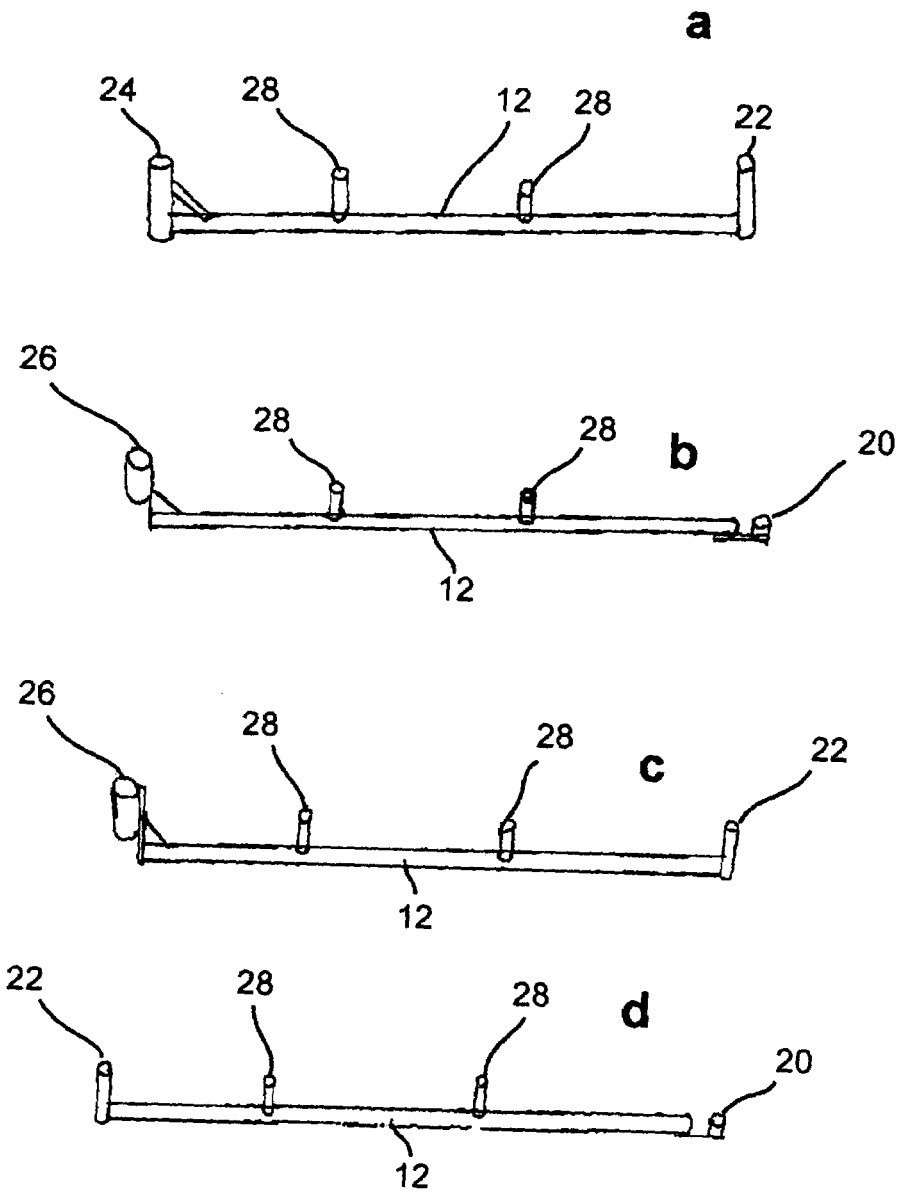

FIG. 2 A base unit (50) is made up of four lower tubes (12) connected at 90 degrees relative to each other in order to form a square. In FIGS. 9 *a–d*, are some of the various combinations of interlocking ends—such as (24) with (22), (26) with (20) or (26) with (22), and (22) with (20)—that lower tubes (12) can have. These ends have different names to be stated later in this description but more importantly, these ends have different sizes so that they interlock into one another. Each lower tube (12) has nipples (28) set perpendicularly along its length for inserting vertical tubes (30) (see FIG. 8).

FIG. 3 In order to reduce the number of pipes on the ground, when four base units (50) are joined, only a central base (80) needs to be put at the center of what is known as a master square (32). The dotted lines represent the now unnecessary lower tubes (12). It may not be necessary to assemble base units (50) as in FIG. 1 to later partially dismantle them in order to build a master square (32). The description of the assembling of a base unit (50) is is for illustrative purpose in order to understand the basic principle of construction. However, base units (50) can be built if one want to have odd sections that break an otherwise square or rectangular maze, or to use linking segments, corridors of sort, leading to other master squares (32). In order to assemble a master square (50), the base units (50) are partially assembled so that the intersecting lower tubes (12) can be inserted in the proper sequence as evidenced in:

FIG. 4 From the bottom up there are four intersecting lower tubes (12). The bottomest of the lower tubes (12) has an end called a connector (20) that fits within a lower tube (12) having a larger end called a perpendicular stem (22) that fits within a lower tube (12) with a still larger end called a larger perpendicular stem (24), and finally, that larger perpendicular stem fits within a lower tube (12) with an ever larger end called a hub connector (26) which receives a vertical master tube (70). It should be noted that a central base (80) can also be substituted for a hub connector (26) as described above. Each lower tube (12) remains perpendicular to the next lower tube (12) because all lower tubes (12) are in the same plane and are thus very limited as to their angular displacements, this creates a cross pattern.

FIG. 5 Each master square (32) can then be joined with other master squares (32) to form a grid (33). The arrangement of FIG. 4 is the center point in FIG. 5 wherein from a hub connector (20-26) radiates four lower tubes (12) and each of those lower tubes (12) have either a perpendicular stem (22) or a larger perpendicular stem (24) which connects to other lower tubes (12) forming the perimeter of the grid (33). A connector (20) always connects with a perpendicular stem (22), a perpendicular stem (22) always connect with a larger perpendicular stem (24), and a larger perpendicular stem (24) always connects with a hub connector (26).

Figure 10:
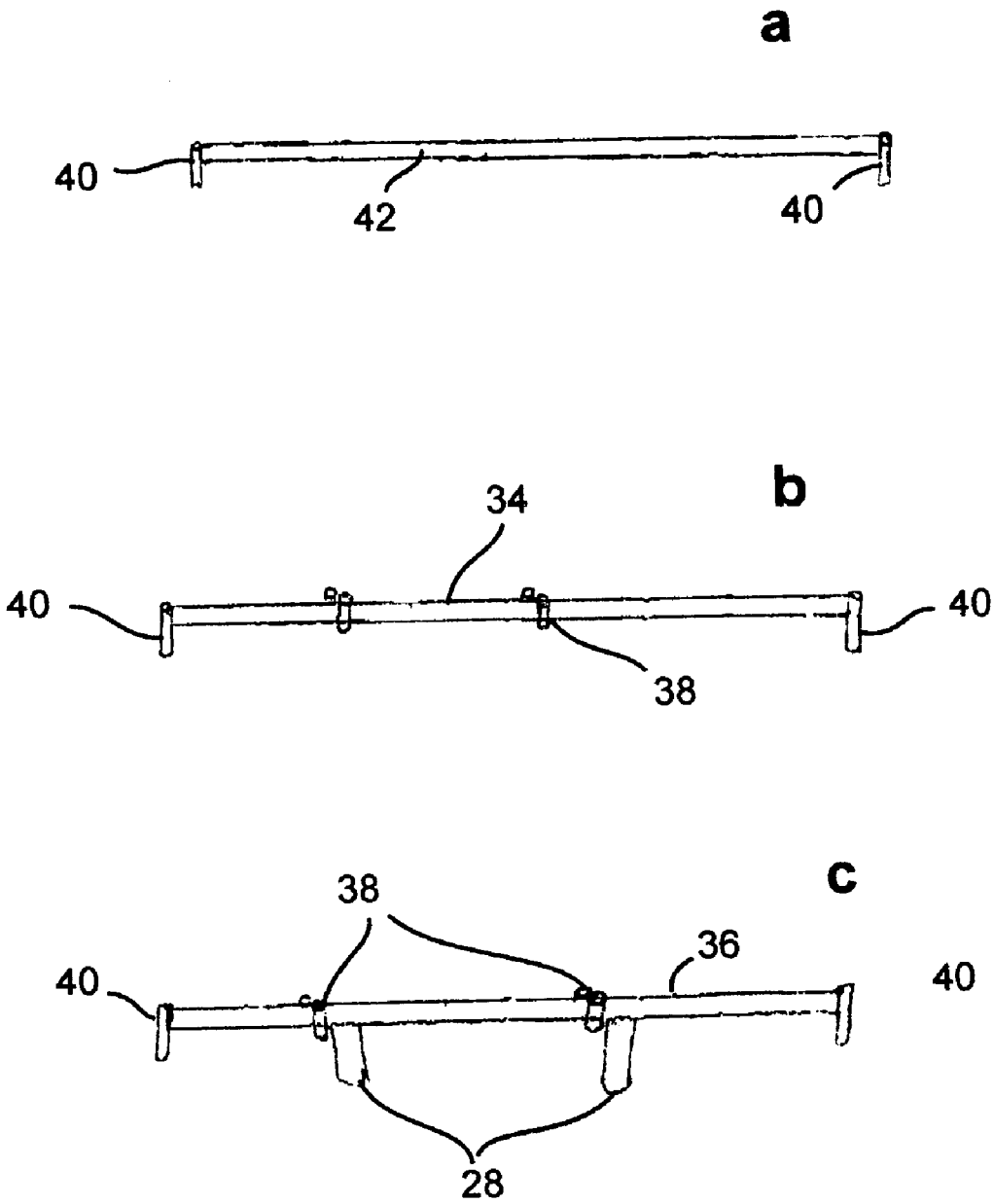

FIGS. 6 and 10 Once the lower structure (18) is done, the upper structure (16) is assembled using a series of vertical tubes (30) that are connected to the nipples (28) of the lower tubes, and master vertical tubes (70) are connected to the lower tubes ends (20–26) or central bases (80), and then, four upper tubes (36) link the master tubes (70) to form an upper base unit (60). The upper tubes (36) also have nipples (28) and have hook receptacles (38) to receive the hooks (40) from transverse bars (42) connecting into the hook receptacles (38). The upper tube (36) differ from the lower tubes (12) by the way that their ends are simply hooks (40) hooking into hook receptacles (38) found on vertical master tubes (70). The vertical tubes (30) are simply used for insertion into the nipples (28) of both the lower tubes (12) and the upper tubes (36). The vertical tubes (30) and master vertical tubes (70) can also be made to exceed the height of transverse bars (42) so that they can carry lighting fixtures to light the inside of the labyrinth at nighttime.

FIG. 7 There is also a second type of upper tube (34), identical to the upper tubes (36) but whithout the nipples (28) and is used within master squares (32). Each upper base unit (60) is completed to finish a master square (32).

FIG. 8 Each master square (32) can connect to the next master square (32) by having mutually compatible components such as a hub connector (26) with a perpendicular stem (24) or a perpendicular stem (22) with a connector (20). The upper structure (16) has its upper tubes (36) and second type upper tubes (34) (see FIG. 7) hooking into hook receptacles (38) on the master vertical tubes (70), and with the transverse bars (42) hooking into the upper tubes (36). The canvas (14) is hung onto both the transverse bars (42) and the upper tubes (34, 36) at the top and the lower tubes (12) at the bottom using strapping means selected for both their securedness and ease of installation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A knockdown labyrinth framework comprising:

a plurality of interconnected tubes and a canvas to create a grid;

said canvas releasably attached to both an upper structure and a lower structure;

said interconnected tubes being further subdivided into lower tubes and upper tubes;

said lower tubes having ends;

said ends having different sizes so as to interlock into one another;

said different sizes of ends being a connector interlocking within a perpendicular stem;

said perpendicular stem interlocking within a larger perpendicular stem;

said larger perpendicular stem interlocking within a hub connector;

each said lower tubes having nipples set perpendicularly along their lengths for inserting vertical tubes;

a central base used as substitute to said hub connector;

first upper tubes connected to vertical tubes;

said upper tubes having hooks at their opposite ends and nipples set perpendicularly along their lengths for inserting said vertical tubes;

said vertical tubes connected to said nipples of lower tubes and said nipples of said first upper tubes;

master vertical tubes connected to hub connectors or central bases;

second upper tubes having hooks to connect to hook receptacles on said master vertical tubes;

transverse bars having hooks to connect to hook receptacles on said first upper tubes;

said canvas being hung onto both said transverse bars and said first and second upper tubes using strapping means.

2. A knockdown labyrinth framework having the blowing method of assembly:

in combination, a connector situated at one end of a first said lower tube is followed by a perpendicular stem situated on a second said lower tube inserted around and through said connector, followed by a larger perpendicular stem inserted around and through said perpendicular stem and followed by said hub connector inserted around and through said larger perpendicular stem;

said combination forming a cross;

joining a plurality of said crosses to form master squares;

lower tubes connecting together to complete master squares and forming a grid;

said vertical tubes connected to nipples of lower tubes and master vertical tubes connected to hub connectors or central bases;

joining vertical tubes to upper tubes and upper tubes to master vertical tubes;

joining transverse bars to upper tubes;

hanging canvas from hooks.

* * * * *